US010766508B2

(12) United States Patent
Taga et al.

(10) Patent No.: US 10,766,508 B2
(45) Date of Patent: Sep. 8, 2020

(54) RAILCAR BOGIE, WHEEL LOAD ADJUSTING METHOD THEREOF, AND WHEEL LOAD ADJUSTING SYSTEM

(71) Applicant: KAWASAKI JUKOGYO KABUSHIKI KAISHA, Kobe-shi, Hyogo (JP)

(72) Inventors: Yukitaka Taga, Kobe (JP); Fumikazu Kounoike, Kakogawa (JP); Yukihiro Sano, Kobe (JP); Takaya Ono, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 247 days.

(21) Appl. No.: 16/065,846

(22) PCT Filed: Nov. 29, 2016

(86) PCT No.: PCT/JP2016/005003
§ 371 (c)(1),
(2) Date: Jun. 25, 2018

(87) PCT Pub. No.: WO2017/110043
PCT Pub. Date: Jun. 29, 2017

(65) Prior Publication Data

US 2019/0009799 A1 Jan. 10, 2019

(30) Foreign Application Priority Data

Dec. 25, 2015 (JP) ..... 2015-252986

(51) Int. Cl.
*B61F 5/30* (2006.01)
*B61F 3/08* (2006.01)
(Continued)

(52) U.S. Cl.
CPC ..... *B61F 5/302* (2013.01); *B61F 3/08* (2013.01); *B61F 5/32* (2013.01); *B61F 5/52* (2013.01)

(58) Field of Classification Search
CPC ..... B23Q 3/00; B23Q 3/183; B23Q 3/186; F16B 7/00; F16B 7/04; F16B 7/0406;
(Continued)

(56) References Cited

U.S. PATENT DOCUMENTS 2,861,798 A * 11/1958 Lenet ..... B60G 11/04 267/45
3,083,034 A * 3/1963 Hollowell ..... B60G 17/023 280/6.159
(Continued)

FOREIGN PATENT DOCUMENTS

JP S55-47950 A 4/1980
JP H11-105709 A 4/1999
(Continued)

OTHER PUBLICATIONS

Dec. 27, 2016 International Search Report issued in International Patent Application No. PCT/JP2016/005003.

*Primary Examiner* — Mark T Le
(74) *Attorney, Agent, or Firm* — Oliff PLC

(57) ABSTRACT

A railcar bogie includes a cross beam, an axle box, a supporting member, a plate spring, and an axle beam. The axle box accommodates a bearing rotatably supporting a wheelset. The supporting member is provided at an upper portion of the axle box. The plate spring supports a car width direction end portion of the cross beam and extends in a car longitudinal direction, and the plate spring includes a car longitudinal direction end portion supported by the supporting member. The axle beam couples the axle box and the cross beam in the car longitudinal direction and is opposed to the plate spring in an upward/downward direction. An
(Continued)

installation seat is provided at an upper surface of the axle beam and includes an installation surface on which a pushing-up device configured to push up a lower surface of the plate spring can be placed.

9 Claims, 4 Drawing Sheets

(51) Int. Cl.
*B61F 5/32* (2006.01)
*B61F 5/52* (2006.01)

(58) Field of Classification Search
CPC ..... F16B 7/18; B61F 5/30; B61F 5/52; B61F 3/02; B61F 5/305; B61F 5/32; B61F 5/325; B61F 5/36; B61F 5/50; B61F 5/302; B61F 5/46; F16C 11/02; F16C 11/04; F16C 9/02; F16C 9/04
USPC ..... 105/206.1, 206.2
See application file for complete search history.

(56) References Cited

U.S. PATENT DOCUMENTS

| | | | | | |
|---|---|---|---|---|---|
| 4,065,153 | A * | 12/1977 | Pringle | B60G 9/003 | 280/86.5 |
| 4,225,152 | A * | 9/1980 | Eaton | B60G 11/10 | 280/124.163 |
| 4,750,718 | A * | 6/1988 | Nickel | B60G 11/40 | 267/149 |
| 8,505,942 | B2 * | 8/2013 | Muck | B60G 11/04 | 267/195 |
| 2015/0083019 | A1 | 3/2015 | Nishimura et al. | | |

FOREIGN PATENT DOCUMENTS

| | | | |
|---|---|---|---|
| JP | 2014-037191 | A | 2/2014 |
| WO | 2013/150720 | A1 | 10/2013 |

* cited by examiner

RAILCAR BOGIE, WHEEL LOAD ADJUSTING METHOD THEREOF, AND WHEEL LOAD ADJUSTING SYSTEM

TECHNICAL FIELD

The present invention relates to a railcar bogie, a wheel load adjusting method of the railcar bogie, and a wheel load adjusting system.

BACKGROUND ART

In a railcar bogie, an axle box accommodating a bearing rotatably supporting a wheelset is supported by a bogie frame through an axle box suspension. For example, in PTL 1, a bogie frame includes a pair of side sills extending in a car longitudinal direction and a cross beam connecting the pair of side sills in a car width direction, and an axle box suspension (axle spring) connects an axle box and the side still of the bogie frame.

PTL 2 proposes a bogie including: a bogie frame from which side sills are omitted; and plate springs each of which is long in a car longitudinal direction. Longitudinal direction middle portions of the plate springs are supported by respective attaching portions provided at both respective car width direction end portions of the cross beam, and both longitudinal direction ends of each plate spring are inserted into respective spring receiving members formed at the axle boxes.

At the time of maintenance of the railcar, wheel load adjusting work is performed, i.e., wheel load balance among wheels is adjusted. For example, in the bogie of PTL 1, a spring constant of the axle spring is changed by inserting a liner between the axle box and the axle spring or pulling out the inserted liner, and with this, the wheel load balance is adjusted.

CITATION LIST

Patent Literature

PTL 1: Japanese Laid-Open Patent Application Publication No. 2014-37191

PTL 2: Japanese Laid-Open Patent Application Publication No. 55-47950

SUMMARY OF INVENTION

Technical Problem

In the bogie of PTL 1, the wheel load adjusting work needs to be performed by attaching two hydraulic jacks between an axle spring seat and the axle box, and therefore, the working property is low.

In the bogie of PTL 2, when adjusting a wheel load, for example, work of forming a gap between the plate spring and the axle box and inserting the liner into the gap may be performed. However, PTL 2 does not specifically mention how to adjust the wheel load.

An object of the present invention is to improve a working property of wheel load adjustment in a non-dismantling state of a railcar.

Solution to Problem

A railcar bogie according to one aspect of the present invention includes: a cross beam supporting a carbody of a railcar; an axle box accommodating a bearing rotatably supporting a wheelset; a supporting member provided at an upper portion of the axle box; a plate spring supporting a car width direction end portion of the cross beam and extending in a car longitudinal direction, the plate spring including a car longitudinal direction end portion supported by the supporting member; and an axle beam coupling the axle box and the cross beam in the car longitudinal direction and opposed to the plate spring in an upward/downward direction, an installation seat being provided at an upper surface of the axle beam, the installation seat including an installation surface on which a pushing-up device is placed, the pushing-up device being configured to push up a lower surface of the plate spring.

A wheel load adjusting method of a railcar bogie according to one aspect of the present invention is a wheel load adjusting method of a railcar bogie, the railcar bogie including: a cross beam supporting a carbody of a railcar; an axle box accommodating a bearing rotatably supporting a wheelset; a supporting member provided at an upper portion of the axle box; a plate spring supporting a car width direction end portion of the cross beam and extending in a car longitudinal direction, the plate spring including a car longitudinal direction end portion supported by the supporting member; and an axle beam coupling the axle box and the cross beam in the car longitudinal direction and opposed to the plate spring in an upward/downward direction, the wheel load adjusting method including: placing a pushing-up device on an installation surface of an installation seat provided at an upper surface of the axle beam, the pushing-up device being configured to push up a lower surface of the plate spring; forming a gap between the supporting member and the axle box by pushing up the lower surface of the plate spring by operating the pushing-up device; and inserting a liner into the gap or pulling out the liner inserted between the supporting member and the axle box.

A wheel load adjusting system according to one aspect of the present invention includes: a railcar bogie; and a pushing-up device, the railcar bogie including a cross beam supporting a carbody of a railcar; an axle box accommodating a bearing rotatably supporting a wheelset; a supporting member provided at an upper portion of the axle box; a plate spring supporting a car width direction end portion of the cross beam and extending in a car longitudinal direction, the plate spring including a car longitudinal direction end portion supported by the supporting member; and an axle beam coupling the axle box and the cross beam in the car longitudinal direction and opposed to the plate spring in an upward/downward direction, the pushing-up device being configured to push up a lower surface of the plate spring, an installation seat being provided at an upper surface of the axle beam, the installation seat including an installation surface on which the pushing-up device is placed.

According to the above configurations, the installation seat on which the pushing-up device can be placed is provided at the upper surface of the axle beam coupling the axle box and the cross beam. With this, when performing work of adjusting wheel load balance in a non-dismantling state, the lower surface of the plate spring can be pushed up by the pushing-up device. Therefore, a gap is formed by pushing up the lower surface of the plate spring, and with this, the liner for adjusting the wheel load balance can be inserted into the gap, or the inserted liner can be easily pulled out from the gap. On this account, in the non-dismantling state of the railcar including the plate spring type railcar bogie, it is unnecessary to detach the plate spring for the wheel load adjustment. Thus, the working property of the wheel load adjustment can be improved.

Advantageous Effects of Invention

According to the present invention, the working property of the wheel load adjustment in the non-dismantling state of the railcar can be improved.

DESCRIPTION OF EMBODIMENTS

Figure 1:
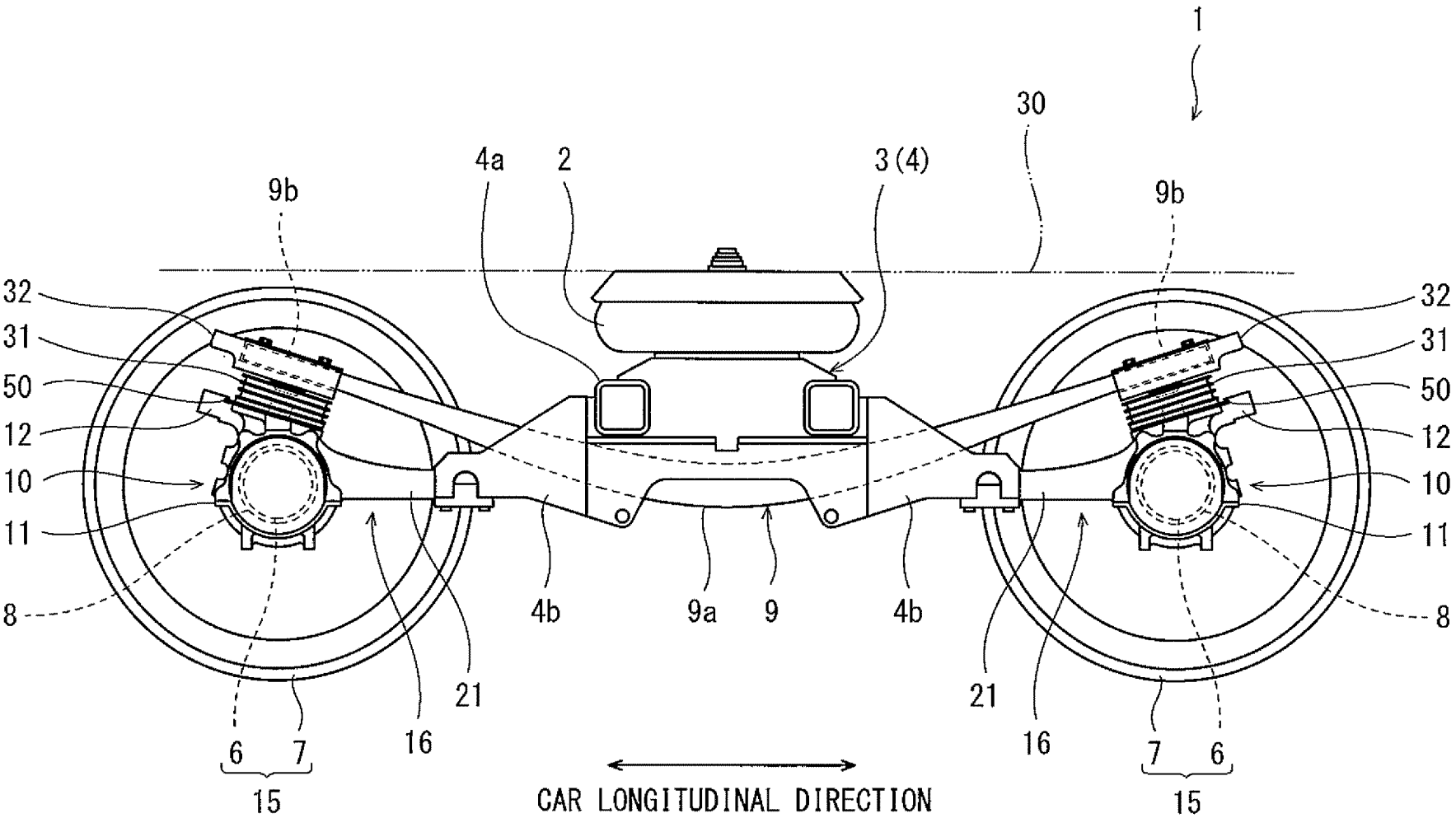
FIG. 1 is a side view of a railcar bogie according to an embodiment.

Hereinafter, an embodiment will be explained with reference to the drawings. In the drawings, the same reference signs are used for the same or corresponding components, and a repetition of the same explanation is avoided.

FIG. 1 is a side view of a railcar bogie 1 according to the embodiment. As shown in FIG. 1, the railcar bogie (hereinafter referred to as a "bogie") 1 includes a bogie frame 3 configured to support a carbody 30 through an air spring 2. The bogie frame 3 includes a cross beam 4 extending in a car width direction at a car longitudinal direction middle of the bogie 1. However, unlike the configuration of a conventional bogie frame, the bogie frame 3 does not include side sills extending in a car longitudinal direction from both respective car width direction end portions 4*a* of the cross beam 4.

Axles 6 each extending in the car width direction are arranged at both respective car longitudinal direction sides of the cross beam 4. Wheels 7 are press-fitted to both respective car width direction sides of each of the axles 6. The axle 6 and the wheels 7 constitute a wheelset 15. A pair of wheelsets 15 provided at the bogie 1 are arranged at both respective car longitudinal direction sides of the cross beam 4 so as to be spaced apart from each other. Bearings 8 rotatably supporting the wheels 7 are provided at both respective car width direction end portions of each axle 6 so as to be located outside the wheels 7 in the car width direction. The bearings 8 are accommodated in respective axle boxes 10.

Each of the axle boxes 10 is elastically coupled to the cross beam 4 of the bogie frame 3 through a corresponding axle box suspension 16. The axle box suspension 16 includes an axle beam 21 coupling the axle box 10 and the cross beam 4 in the car longitudinal direction. The axle beam 21 is formed integrally with the axle box 10 and extends from the axle box 10 toward the cross beam 4 in the car longitudinal direction. A tubular portion 21*b* (see FIG. 2) that is open at both car width direction sides is formed at a tip end of the axle beam 21. The tubular portion 21*b* is elastically coupled to a receiving seat 4*b* through a rubber bushing and a core rod (not shown), the receiving seat 4*b* being provided at the car width direction end portion 4*a* of the cross beam 4.

Each of plate springs 9 extends between the axle box 10 and the cross beam 4 in the car longitudinal direction. Car longitudinal direction middle portions 9*a* of the plate springs 9 support the respective car width direction end portions 4*a* of the cross beam 4 from below, and both car longitudinal direction end portions 9*b* of each of the plate springs 9 are indirectly supported by the respective axle boxes 10. To be specific, the plate spring 9 has both the function of a primary suspension and the function of a conventional side sill.

Both car longitudinal direction end portions 9*b* of each of the plate springs 9 are supported by the respective axle boxes 10 through respective supporting members 31. Each of the supporting members 31 is provided at an upper portion of the axle box 10. The supporting member 31 includes a receiving member 32 and a vibrationproof rubber unit 33. The receiving member 32 supports the car longitudinal direction end portion 9*b* of the plate spring 9 from below. The vibrationproof rubber unit 33 is substantially columnar and is inserted between the axle box 10 and the receiving member 32. The vibrationproof rubber unit 33 is constituted by a plurality of rubber plates 33*a* and a plurality of metal plates 33*b* interposed among the plurality of rubber plates 33*a* (see FIG. 2). An upper surface of the vibrationproof rubber unit 33 is inclined obliquely downward toward a middle side in the car longitudinal direction. It should be noted that the upper surface of the vibrationproof rubber unit 33 does not have to be inclined as long as the upper surface of the vibrationproof rubber unit 33 is substantially parallel to a lower surface of the car longitudinal direction end portion 9*b* of the plate spring 9.

The axle box 10 includes: an axle box main body 11 in which the bearing 8 is accommodated; and a spring seat 12 indirectly supporting the plate spring 9. In the present embodiment, the spring seat 12 is formed integrally with the axle box main body 11. A liner set 50 constituted by a plurality of liners 51 and 52 (see FIG. 4) described below is interposed between the spring seat 12 and the vibrationproof rubber unit 33, specifically, between an upper surface of the spring seat 12 and a lower surface of the vibrationproof rubber unit 33.

The liner set 50 is a group of liners used to adjust wheel load balance among the wheels 7 in a non-dismantling state of a railcar. Wheel load adjusting work is performed by selectively interposing the liner set 50 between the plate spring 9 and the axle box 10 through which a load from the carbody 30 is transferred to the wheel 7.

Figure 2:
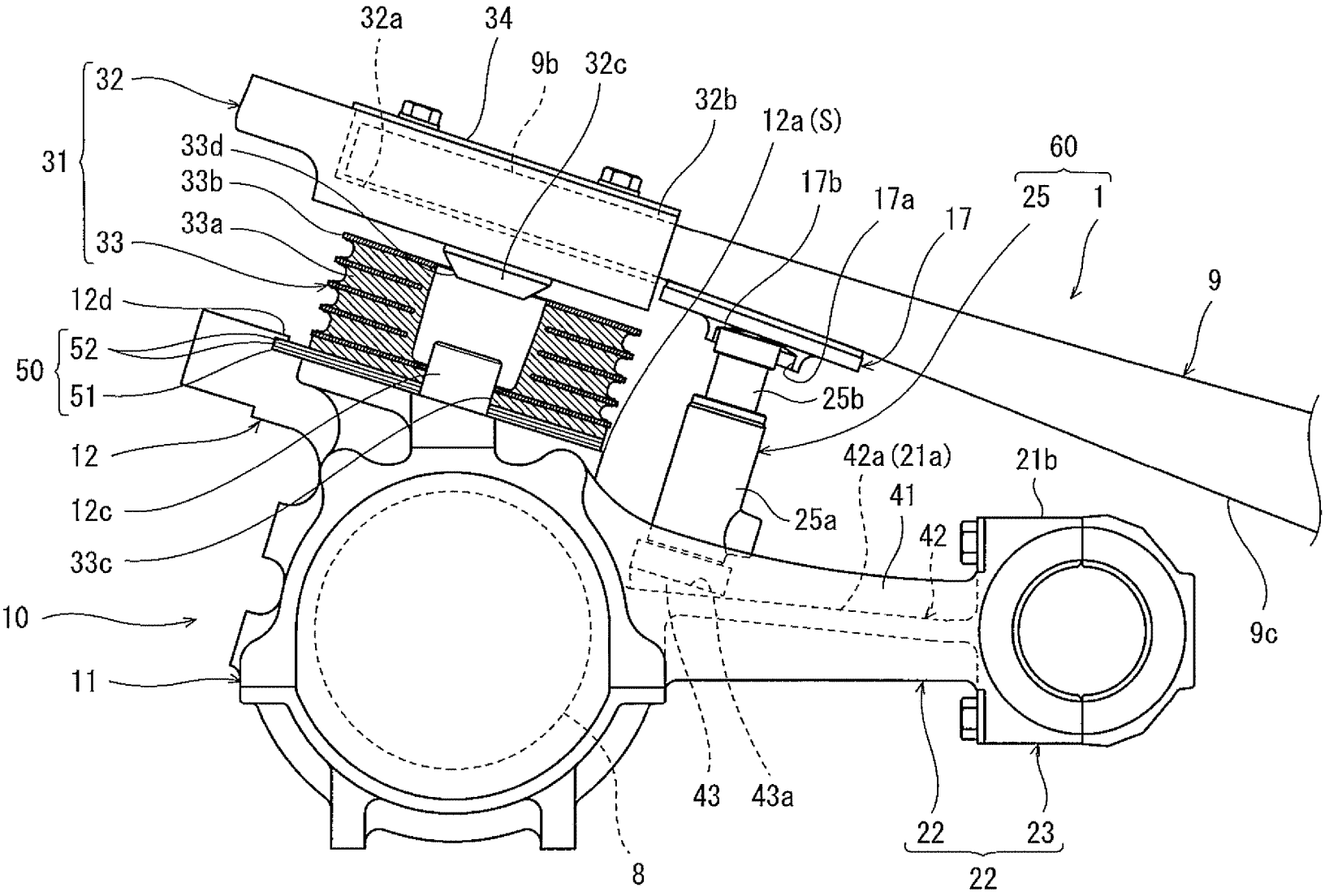
FIG. 2 is a partially sectional side view showing major components of the bogie of FIG. 1 with a pushing-up device provided at an axle beam of the bogie.
Figure 3:
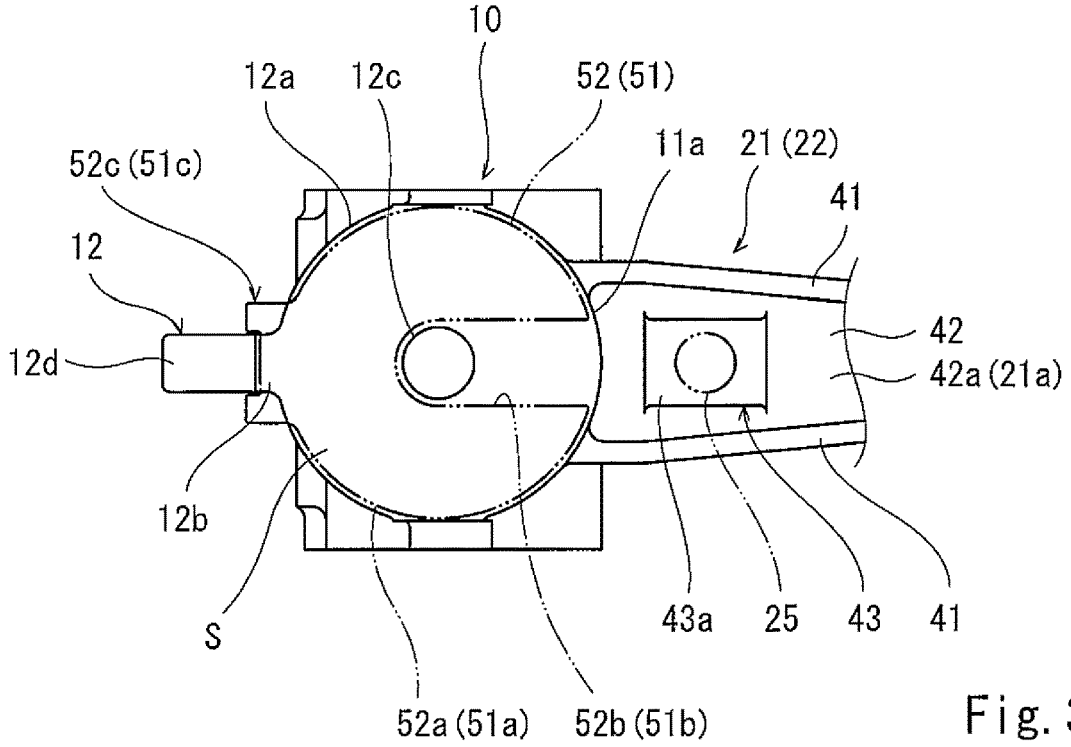
FIG. 3 is a plan view showing an axle box of FIG. 2 and its periphery.

FIG. 2 is a side view showing major components of the bogie 1 with a hydraulic jack 25 provided at an upper surface 21*a* of the axle beam 21 shown in FIG. 1. FIG. 3 is a plan view showing the axle box 10 of FIG. 2 and its periphery. As shown in FIGS. 2 and 3, the axle beam 21 includes an axle beam main body portion 22 and an axle beam end portion 23. The axle beam main body portion 22 includes: a pair of side plate portions 41 extending from the axle box 10 in the car longitudinal direction; and a coupling plate portion 42 coupling the pair of side plate portions 41 in the car width direction. A sectional shape of the axle beam main body portion 22 when viewed from the car longitudinal direction is an H shape.

The axle beam main body portion 22 is provided with an installation seat 43 at which the hydraulic jack 25 can be placed. Specifically, the installation seat 43 is provided at an upper surface 42*a* of the coupling plate portion 42 while being covered with the pair of side plate portions 41 from both sides in the car width direction. The installation seat 43 may be formed integrally with the axle beam 21 or may be fixed to the axle beam 21 by welding or the like.

The installation seat 43 includes an installation surface 43*a* at which the hydraulic jack 25 can be placed, and the installation surface 43*a* is substantially parallel to a lower surface 9*c* of the plate spring 9. An inclination angle of the installation surface 43*a* is different from an inclination angle of the upper surface 42*a* of the coupling plate portion 42.

The hydraulic jack 25 is attached in a direction substantially vertical to the lower surface 9*c* of the plate spring 9. Since the lower surface 9*c* of the plate spring 9 is inclined with respect to a horizontal surface, the hydraulic jack 25 is provided so as to be also inclined with respect to the horizontal surface.

As shown in FIG. 2, a wheel load adjusting system 60 is substantially constituted by the bogie 1 and the hydraulic jack 25. The hydraulic jack 25 includes: a substantially cylindrical cylinder 25*a* including an oil chamber to which operating oil is supplied; and a piston 25*b* which partially projects from an upper surface of the cylinder 25*a*. The piston 25*b* expands and contracts in an axial direction.

When performing the wheel load adjusting work, a worker places the hydraulic jack 25 on the installation seat 43 provided at the coupling plate portion 42. The installation seat 43 is covered with the pair of side plate portions 41 of the axle beam 21 from both sides in the car width direction. When the hydraulic jack 25 is placed at the installation seat 43, the hydraulic jack 25 is arranged so as to be surrounded by the pair of side plate portions 41 and coupling plate portion 42 of the axle beam 21, the plate spring 9, and the axle box main body 11. Therefore, the hydraulic jack 25 is prevented from falling from an installation position when the hydraulic jack 25 is operated.

A pad 17 made of steel is attached to the lower surface 9*c* of the plate spring 9, and a rubber plate is attached to a surface of the pad 17, the surface contacting the plate spring 9. The pad 17 includes: a groove portion 17*a* in which an upper end portion of the piston 25*b* is fitted; and a contact surface 17*b*. The pad 17 is attached when placing the hydraulic jack 25 in the wheel load adjusting work. As shown in FIG. 2, the contact surface 17*b* is subjected to spherical surface processing. With this, even when there is an angular difference between an upper surface of the hydraulic jack 25 and the lower surface 9*c* of the plate spring 9, such difference can be absorbed, and force from the hydraulic jack 25 can be applied to the lower surface 9*c* of the plate spring 9 in a direction vertical to the lower surface 9*c*. When a height of the hydraulic jack 25 is smaller than an interval between the pad 17 and the installation seat 43, a spacer member having a predetermined thickness may be interposed between a lower surface of the cylinder 25*a* and the installation surface 43*a* of the installation seat 43.

In the present embodiment, the liner set 50 is interposed between the spring seat 12 of the axle box 10 and the vibrationproof rubber unit 33 in advance. It should be noted that the liner set 50 may be interposed between the vibrationproof rubber unit 33 and the receiving member 32. The illustrated liner set 50 of the present embodiment is constituted by a plurality of liners including one first liner 51 and two second liners 52, the first and second liners 51 and 52 being different in thickness from each other. It should be noted that to realize appropriate wheel load values, the number of liners and the thicknesses of the liners are suitably selected. The shape of the liner will be described later.

The spring seat 12 includes an installation portion 12*a* having a substantially circular shape in a plan view, and the liners 51 and 52 are provided at the installation portion 12*a*. An upper surface S of the installation portion 12*a* is substantially parallel to the lower surface 9*c* of the plate spring 9 and is inclined obliquely downward toward the middle side in the car longitudinal direction.

A first projecting portion 12*c* and a second projecting portion 12*d* are formed at the spring seat 12. The first projecting portion 12*c* projects upward from a middle of the installation portion 12*a*, and the second projecting portion 12*d* projects upward from a car longitudinal direction end portion of the spring seat 12. The first projecting portion 12*c* is substantially columnar and is inserted into a lower through hole 33*c* formed on the lower surface of the vibrationproof rubber unit 33. The second projecting portion 12*d* is located adjacent to a protruding portion 12*b* of the installation portion 12*a* and projects upward from the protruding portion 12*b*. Each of the first liner 51 and the second liner 52 engages with the first projecting portion 12*c* and the second projecting portion 12*d*.

The receiving member 32 has a substantially rectangular shape in a plan view and supports the car longitudinal direction end portion 9*b* of the plate spring 9. The receiving member 32 includes a bottom wall portion 32*a*, an outer wall portion 32*b*, and a projecting portion 32*c* projecting downward from a lower surface of the bottom wall portion 32*a*. The projecting portion 32*c* is inserted into an upper through hole 33*d* of the vibrationproof rubber unit 33.

Next, the shapes of the liners 51 and 52 and the like will be explained.

Figure 4A:
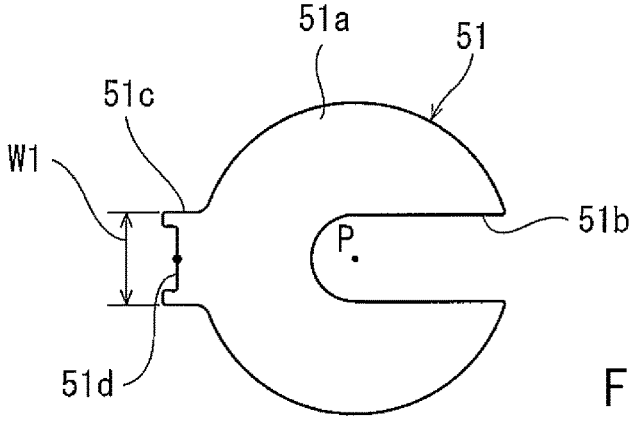
FIG. 4 is a plan view showing first and second liners shown in FIG. 2.
Figure 4B:
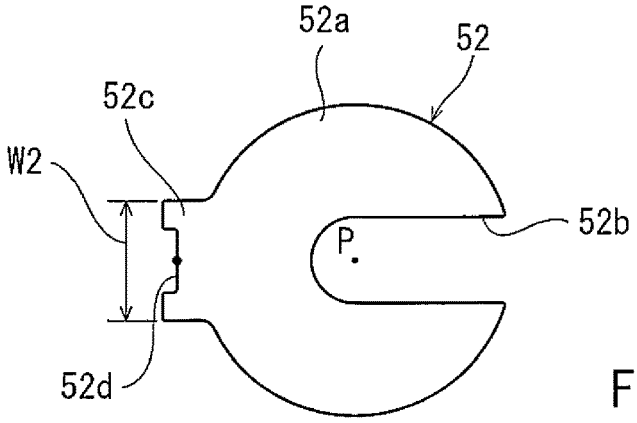

FIG. 4A is a plan view of the first liner 51 shown in FIG. 2. FIG. 4B is a plan view of the second liner 52 shown in FIG. 2. As shown in FIGS. 4A and 4B, the first liner 51 includes a pressure receiving portion 51*a*, a first engaging portion 51*b*, and a second engaging portion 51*c*, and the second liner 52 includes a pressure receiving portion 52*a*, a first engaging portion 52*b*, and a second engaging portion 52*c*. The pressure receiving portions 51*a* and 52*a* receives a load from the plate spring 9. In a plan view, each of outer edges of the pressure receiving portions 51*a* and 52*a* has a substantially C shape obtained by cutting out a part of a circle.

The first engaging portion (51*b*, 52*b*) is formed by recessing a part of the outer edge of the pressure receiving portion (51*a*, 52*a*) inward. Specifically, the first engaging portion (51*b*, 52*b*) is recessed toward a center P of a circle, a part of the circle being formed by the outer edge of the pressure receiving portion (51*a*, 52*a*). The second engaging portion (51*c*, 52*c*) projects outward from the pressure receiving portion (51*a*, 52*a*) at an opposite side of the first engaging portion (51*b*, 52*b*) and includes a concave cutout portion (51*d*, 52*d*) at a tip end of the second engaging portion (51*c*, 52*c*). A cutout width of the cutout portion (51*d*, 52*d*) is set to be equal to or slightly larger than a car width direction size of the second projecting portion 12*d*.

The first liner 51 and the second liner 52 are different in thickness from each other, and a width direction size W1 of the first liner 51 is smaller than a width direction size W2 of the second engaging portion 52*c*. A worker performs work of attaching and detaching the liner in the car longitudinal direction by holding the second engaging portion of the liner with a tool, such as pliers. Since the width of the second engaging portion is different depending on the thickness of the liner, the liners of different thicknesses are easily distinguished. Thus, the attaching and detaching work is facilitated.

As shown in FIGS. 3 and 4, when the liners 51 and 52 are inserted between the spring seat 12 and the vibrationproof rubber unit 33, the first engaging portions 51*b* and 52*b* engage with the first projecting portion 12*c* of the spring seat 12, and the second engaging portions 51*c* and 52*c* engage with the second projecting portion 12*d* of the spring seat 12.

Since the first engaging portions 51*b* and 52*b* of the liners 51 and 52 engage with the first engaged portion 12*c* located at a center of the spring seat 12, the liners 51 and 52 are restricted from being displaced inward in the car longitudinal direction and the car width direction. Further, since the second engaging portions 51*c* and 52*c* engage with the second engaged portion 12*d* provided at a car longitudinal direction outer end portion of the spring seat 12, the liners 51 and 52 are restricted from being displaced outward in the car longitudinal direction. Further, since the concave cutout portions 51*d* and 52*d* fits the second engaged portion 12*d*, the liners 51 and 52 are also restricted from being displaced rotationally about the first engaged portion 12*c*.

Figure 5:
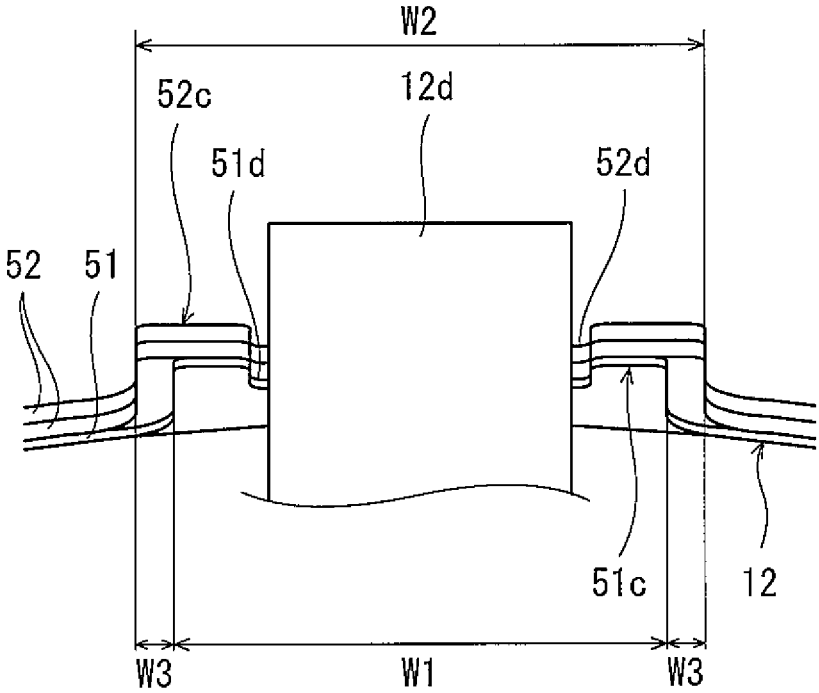
FIG. 5 is a diagram showing that one first liner and two second liners are inserted into the axle box shown in FIG. 2.

FIG. 5 is a diagram showing that one first liner 51 and two second liners 52 are inserted into the axle box 10. As shown in FIG. 5, the thin first liner 51 is inserted under the thick second liner 52 and is sandwiched by the spring seat 12 and the second liner 52. Since the width direction size W1 of the cutout portion 51*d* of the first liner 51 is smaller than the width direction size W2 of the cutout portion 52*d* of the second liner 52 as described above, a level difference portion W3 is formed between the second engaging portion 51*c* of the first liner 51 and the second engaging portion 52*c* of the second liner 52. With this, a worker can easily pull out the desired liner by holding the second engaging portion.

In the bogie 1 and the wheel load adjusting system configured as above, the wheel load adjustment is performed by the following steps.

To be specific, in a first step, a pushing-up device 25 (see FIG. 2), such as a hydraulic jack, is placed at the axle beam 21. Next, in a second step, the hydraulic jack 25 operates to push up the lower surface 9*c* of the plate spring 9. With this, a gap is formed between the receiving member 32 and the vibrationproof rubber unit 33. Last, in a third step, by lifting the vibrationproof rubber unit 33, a gap is formed between the spring seat 12 of the axle box 10 and the vibrationproof rubber unit 33. Thus, the liners 51 and 52 can be inserted into the gap, or the inserted liners 51 and 52 can be pulled out from the gap.

The bogie 1 and the wheel load adjusting system 60 configured as above have the following effects.

In the bogie 1 including the plate spring 9 and in the wheel load adjusting system 60 including the bogie 1, the installation seat 43 at which the hydraulic jack 25 can be placed is provided at the upper surface 21*a* of the axle beam 21 opposed to the plate spring 9 in an upward/downward direction. With this, in the wheel load adjusting work, the lower surface 9*c* of the plate spring 9 can be pushed up by the hydraulic jack 25. Therefore, by pushing up the lower surface 9*c* of the plate spring 9 to form a gap between the spring seat 12 and the vibrationproof rubber unit 33, the liners 51 and 52 for adjusting the wheel load balance can be attached or detached. On this account, when performing the wheel load adjusting work in the non-dismantling state of the railcar including the plate spring type bogie 1, it is unnecessary to detach the plate spring 9. Thus, the working property of the wheel load adjustment can be improved.

In wheel load adjusting work of a bogie including a typical bogie frame, two hydraulic jacks are required for each axle box. However, according to the present embodiment, the wheel load adjusting work can be performed by one hydraulic jack 25. Therefore, the working property can be improved.

Since the installation surface 43*a* of the installation seat 43 is substantially parallel to the lower surface 9*c* of the plate spring 9, the hydraulic jack 25 can be easily attached in a direction substantially vertical to the plate spring 9. Therefore, pressing force generated by the hydraulic jack 25 is easily applied to the lower surface 9*c* of the plate spring 9 in the direction substantially vertical to the lower surface 9*c*. Further, the pressing force necessary in the wheel load adjusting work can be made minimum as compared to a case where the hydraulic jack is attached so as to be inclined with respect to the lower surface of the plate spring.

The installation seat 43 is provided at the upper surface 42*a* of the coupling plate portion 42 so as to be covered with the pair of side plate portions 41 of the axle beam 21 from both sides in the car longitudinal direction and both sides in the car width direction. With this, when the hydraulic jack 25 is placed on the installation seat 43, the hydraulic jack 25 is arranged so as to be surrounded by the pair of side plate portions 41, the coupling plate portion 42, the plate spring 9, and the axle box main body 11, so that the hydraulic jack 25 can be prevented from falling outward from the axle beam 21.

In a side view, the inclination angle of the installation surface 43*a* of the installation seat 43 is different from the inclination angle of the upper surface 42*a* of the coupling plate portion 42. With this, the installation seat 43 and the coupling plate portion 42 can be designed independently, and this can improve the degree of freedom of the design.

The receiving member 32 is fixed to the vibrationproof rubber unit 33, and a cover member 34 covering the car longitudinal direction end portion 9*b* of the plate spring 9 from above is fixed to the receiving member 32. With this, when the hydraulic jack 25 pushes up the lower surface 9*c* of the plate spring 9, the receiving member 32 is also pushed upward together with the plate spring 9. As a result, a gap can be formed between the vibrationproof rubber unit 33 and the receiving member 32. After that, by lifting the vibrationproof rubber unit 33, a gap to or from which the liner is attached or detached can be formed between the spring seat 12 of the axle box 10 and the vibrationproof rubber unit 33.

The first liner 51 and the second liner 52 which are different in thickness from each other include the respective second engaging portions 51*c* and 52*c* which are different in outer shape from each other. In the present embodiment, the second engaging portion 52*c* of the second liner 52 is larger in width direction size than the second engaging portion 51*c* of the first liner 51. Therefore, when the first liner 51 and the second liner 52 are stacked between the spring seat 12 and the vibrationproof rubber unit 33, a level difference is formed between the second engaging portion 51*c* of the first liner 51 and the second engaging portion 52*c* of the second liner 52. On this account, a worker can easily recognize a thickness difference between the stacked liners 51 and 52 based on the level difference and can easily hold the second engaging portion of the desired liner as a holding margin. With this, the working property when performing, for example, work of pulling out the liner having a desired thickness among the plurality of liners 51 and 52 is improved.

Since the thin first liner 51 is sandwiched between the thick second liner 52 and the spring seat 12 of the axle box 10, the second engaging portion 51*c* of the first liner 51 is hardly detached from the second engaged portion 12*d* of the axle box 10. Thus, the first liner 51 can be prevented from falling off from the axle box 10 while realizing a satisfactory engaging state. Since the outer shape of an upper layer is larger among the outer shapes of the second engaging portions 51*c* and 52*c* stacked on each other, the second engaging portion 52*c* of the upper layer is easily held, and work of pulling out the liners 51 and 52 in order from the upper layer can be easily performed.

The present invention is not limited to the above embodiment, and modifications, additions, and eliminations may be made within the scope of the present invention. In the above embodiment, the width direction sizes W1 and W2 of the second engaging portions 51*c* and 52*c* of the liners 51 and 52 are made different from each other, and with this, the outer shapes of the second engaging portions 51*c* and 52*c* are made different from each other. However, the above embodiment is not limited to this configuration, and the outer shapes of the second engaging portions 51*c* and 52*c* may be any shapes as long as the thickness difference between the liners 51 and 52 engaged with the second engaged portion 12*d* provided at the spring seat 12 of the axle box 10 is recognizable. For example, colors of the second engaging portions 51*c* and 52*c* may be made different from each other by painting. In the above embodiment, the second engaged portion 12*d* provided at the spring seat 12 of the axle box 10 projects outward from the car longitudinal direction outer end portion of the installation portion 12*a*. However, the above embodiment is not limited to this. For example, the second engaged portion 12*d* may project outward from a car width direction outer end portion of the installation portion 12*a*. To be specific, the liners 51 and 52 may be inserted between the spring seat 12 and the vibrationproof rubber unit 33 from an outside in the car width direction. The pushing-up device 25 is not limited to the hydraulic jack and may be an air jack or the like. In the above embodiment, there are two types of liners that are different in thickness from each other, but there may be two or more types of liners.

REFERENCE SIGNS LIST

1 railcar bogie
4 cross beam
4 wheelset
9 plate spring
9*c* lower surface
10 axle box
21 axle beam
21*a* upper surface
25 pushing-up device
30 carbody
31 supporting member
32 receiving member
34 cover member
41 side plate portion
42 coupling plate portion
43 installation seat
43*a* installation surface
51 first liner
51*a* pressure receiving portion
51*c* second engaging portion (engaging portion)
52 second liner
52*a* pressure receiving portion
52*c* second engaging portion (engaging portion)
60 wheel load adjusting system

The invention claimed is:

1. A railcar bogie comprising:
a cross beam supporting a carbody of a railcar;
an axle box accommodating a bearing rotatably supporting a wheelset;
a supporting member provided at an upper portion of the axle box;
a plate spring supporting a car width direction end portion of the cross beam and extending in a car longitudinal direction, the plate spring including a car longitudinal direction end portion supported by the supporting member; and
an axle beam coupling the axle box and the cross beam in the car longitudinal direction and opposed to the plate spring in an upward/downward direction,
an installation seat being provided at an upper surface of the axle beam, the installation seat including an installation surface on which a pushing-up device is placed, the pushing-up device being configured to push up a lower surface of the plate spring.

2. The railcar bogie according to claim 1, wherein the installation surface is substantially parallel to the lower surface of the plate spring.

3. The railcar bogie according to claim 1, wherein:
the axle beam includes
a pair of side plate portions extending from the axle box in the car longitudinal direction and
a coupling plate portion coupling the pair of side plate portions in a car width direction and including the upper surface; and
the installation seat is provided at the upper surface of the coupling plate portion so as to be covered with the pair of side plate portions from both sides in the car width direction.

4. The railcar bogie according to claim 3, wherein an angle of the installation surface of the installation seat is different from an angle of the upper surface of the coupling plate portion.

5. The railcar bogie according to claim 1, further comprising a cover member covering the car longitudinal direction end portion of the plate spring from above, wherein:
the supporting member includes a receiving member supporting the car longitudinal direction end portion of the plate spring from below, the cover member being fixed to the receiving member; and
by pressing force applied to the plate spring by the pushing-up device placed on the installation surface, the cover member is pushed up together with the plate spring and the receiving member.

6. The railcar bogie according to claim 1, further comprising a plurality of liners interposed between the axle box and the plate spring, wherein:
each of the liners includes
a pressure receiving portion configured to receive a load from the plate spring and
an engaging portion projecting outward from the pressure receiving portion and engaged with an engaged portion of the axle box;
thicknesses of the liners are different from one another; and
outer shapes of the engaging portions of the liners are different from one another depending on the thicknesses of the liners.

7. The railcar bogie according to claim 6, wherein:
the plurality of liners comprise a first liner and a second liner;
the first liner is thinner than the second liner;
the outer shape of the engaging portion of the first liner is smaller than the outer shape of the engaging portion of the second liner; and
the first liner is stacked under the second liner.

8. A wheel load adjusting method of a railcar bogie, the railcar bogie including: a cross beam supporting a carbody of a railcar; an axle box accommodating a bearing rotatably supporting a wheelset; a supporting member provided at an upper portion of the axle box; a plate spring supporting a car width direction end portion of the cross beam and extending in a car longitudinal direction, the plate spring including a car longitudinal direction end portion supported by the supporting member; and an axle beam coupling the axle box and the cross beam in the car longitudinal direction and opposed to the plate spring in an upward/downward direction, the wheel load adjusting method comprising:

placing a pushing-up device on an installation surface of an installation seat provided at an upper surface of the axle beam, the pushing-up device being configured to push up a lower surface of the plate spring;

forming a gap between the supporting member and the axle box by pushing up the lower surface of the plate spring by operating the pushing-up device; and inserting a liner into the gap or pulling out the liner inserted between the supporting member and the axle box.

9. A wheel load adjusting system comprising:

a railcar bogie; and a pushing-up device, the railcar bogie including a cross beam supporting a carbody of a railcar;

an axle box accommodating a bearing rotatably supporting a wheelset;

a supporting member provided at an upper portion of the axle box;

a plate spring supporting a car width direction end portion of the cross beam and extending in a car longitudinal direction, the plate spring including a car longitudinal direction end portion supported by the supporting member; and an axle beam coupling the axle box and the cross beam in the car longitudinal direction and opposed to the plate spring in an upward/downward direction, the pushing-up device being configured to push up a lower surface of the plate spring, an installation seat being provided at an upper surface of the axle beam, the installation seat including an installation surface on which the pushing-up device is placed.

* * * * *